US008193711B2

(12) United States Patent
Deguchi et al.

(10) Patent No.: US 8,193,711 B2
(45) Date of Patent: Jun. 5, 2012

(54) METAL HALIDE LAMP

(75) Inventors: Makoto Deguchi, Imabari (JP); Kousuke Ueda, Imabari (JP)

(73) Assignee: Harison Toshiba Lighting Corp., Imabari-shi (JP)

( * ) Notice: Subject to any disclaimer, the term of this patent is extended or adjusted under 35 U.S.C. 154(b) by 224 days.

(21) Appl. No.: 12/513,929

(22) PCT Filed: Jul. 25, 2007

(86) PCT No.: PCT/JP2007/064604

§ 371 (c)(1),
(2), (4) Date: May 7, 2009

(87) PCT Pub. No.: WO2008/056469

PCT Pub. Date: May 15, 2008

(65) Prior Publication Data

US 2010/0045184 A1 Feb. 25, 2010

(30) Foreign Application Priority Data

Nov. 9, 2006 (JP) ..... 2006-303757
Dec. 12, 2006 (JP) ..... 2006-334695

(51) Int. Cl.
*H01J 17/20* (2012.01)
*H01J 61/12* (2006.01)

(52) U.S. Cl. ..... 313/638; 313/570; 313/631; 313/637; 313/642; 313/643

(58) Field of Classification Search ..... 313/631, 313/638, 570, 637, 642, 643
See application file for complete search history.

(56) References Cited

U.S. PATENT DOCUMENTS 6,353,289 B1 3/2002 Ishigami et al.
6,528,946 B2 3/2003 Ishigami et al.
6,653,801 B1 11/2003 Takeda et al.
6,861,807 B2 3/2005 Born et al.
6,873,109 B2 3/2005 Ishigami et al.
7,057,349 B2 6/2006 Ishigami et al.
7,126,281 B2 10/2006 Grundmann et al.
(Continued)

FOREIGN PATENT DOCUMENTS

EP 1 063 681 12/2000
(Continued)

OTHER PUBLICATIONS

U.S. Appl. No. 12/674,360, filed Feb. 19, 2010, Deguchi, et al.
(Continued)

*Primary Examiner* — Peter Macchiarolo
*Assistant Examiner* — Thomas A Hollweg
(74) *Attorney, Agent, or Firm* — Oblon, Spivak, McClelland, Maier & Neustadt, L.L.P.

(57) ABSTRACT

A metal halide lamp is comprised of an airtight tube having a discharge section in which a discharge space is formed; a discharge medium which is enclosed in the discharge space, contains metal halide exhibiting a molar ratio of sodium halide to scandium halide of 1.5 or below and 8 atm or higher of xenon but does not substantially contain mercury; and a pair of electrodes with their tip ends arranged to oppose to each other in the discharge space, wherein halogen atoms bonded to metal in the metal halide mostly consist of iodine and bromine atoms, and a ratio of the bromine atoms is in a range of 10 to 50% and the total amount of the metal halide enclosed is 0.02 mg/μl or less.

6 Claims, 6 Drawing Sheets

U.S. PATENT DOCUMENTS

| | | | | |
|---|---|---|---|---|
| 2002/0017848 | A1 | 2/2002 | Minamihata et al. | |
| 2002/0027421 | A1 | 3/2002 | Kaneko et al. | |
| 2003/0222584 | A1* | 12/2003 | Deguchi et al. | 313/638 |
| 2005/0082987 | A1* | 4/2005 | Uemura et al. | 313/637 |
| 2005/0093455 | A1 | 5/2005 | Tamura et al. | |
| 2005/0122047 | A1 | 6/2005 | Kato et al. | |
| 2006/0255741 | A1 | 11/2006 | Ishigami et al. | |
| 2007/0069655 | A1 | 3/2007 | Ishigami et al. | |

FOREIGN PATENT DOCUMENTS

| | | |
|---|---|---|
| EP | 1 158 567 | 11/2001 |
| EP | 1 339 090 | 8/2003 |
| JP | 6 338285 | 12/1994 |
| JP | 11 238488 | 8/1999 |
| JP | 2000 243349 | 9/2000 |
| JP | 2002 93368 | 3/2002 |
| JP | 2002 110099 | 4/2002 |
| JP | 2003 187742 | 7/2003 |
| JP | 2004 528686 | 9/2004 |
| JP | 2004 288629 | 10/2004 |
| WO | 03 030211 | 4/2003 |

OTHER PUBLICATIONS

Supplementary European search report (Art. 153(7) EPC) and the European search opinion issued Apr. 3, 2011, in PCT Application No. 07791320.0.

* cited by examiner

| Ratio of Br (%) | Ratio of I (%) | Lamp voltage(V) | Total flux (lm) | Flickering | Judgment |
|---|---|---|---|---|---|
| 0 | 100 | 58 | 2600 | Yes | × |
| 10 | 90 | 55 | 2550 | No | ○ |
| 30 | 70 | 51 | 2250 | No | ○ |
| 50 | 50 | 48 | 2050 | No | ○ |
| 70 | 30 | 46 | 1900 | No | × |
| 100 | 0 | 37 | 1800 | Yes | × |

| | Enclosed amount of $ZnI_2$ | | Crack leakage | Total flux (lm) | Lamp Voltage(V) | Flickering | Judgment |
|---|---|---|---|---|---|---|---|
| | (mg) | (wt%) | | | | | |
| Lamp 1 | 0 | 0 | Yes | 2700 | 43 | No | × |
| Lamp 2 | 0. 002 | 0. 5 | Yes | 2550 | 45 | No | × |
| Lamp 3 | 0. 004 | 1. 0 | No | 2400 | 47 | No | O |
| Lamp 4 | 0. 010 | 2. 3 | No | 2250 | 51 | No | O |
| Lamp 5 | 0. 015 | 3. 5 | No | 2150 | 53 | No | O |
| Lamp 6 | 0. 022 | 5. 0 | No | 2050 | 54 | No | O |
| Lamp 7 | 0. 030 | 6. 7 | No | 1900 | 58 | Yes | × |

FIG. 9

| | Diameter R of electrode tip end (mm) | Electrode melting | Crack leakage | Judgment |
|---|---|---|---|---|
| Lamp 8 | 0. 20 | No | Yes | × |
| Lamp 9 | 0. 25 | No | No | ○ |
| Lamp 10 | 0. 33 | No | No | ○ |
| Lamp 11 | 0. 38 | No | No | ○ |
| Lamp 12 | 0. 40 | Yes | Yes | × |

METAL HALIDE LAMP

TECHNICAL FIELD

The present invention relates to a metal halide lamp used for vehicle headlights and substantially not containing mercury.

The metal halide lamp not containing mercury (hereinafter referred to as "mercury-free lamp") is known from, for example, JP-A 2004-288629 (KOKAI) (Patent Reference 1) and the like. At present, a discharge medium of the mercury-free lamp is mainly comprised of sodium-scandium-based metal halide and xenon, and properties same as or higher than those of a mercury-containing metal halide lamp can be obtained. Other known inventions of the sodium-scandium-based mercury-free lamp include JP-A 11-238488 (KOKAI) (Patent Reference 2), JP-A 2002-93368 (KOKAI) (Patent Reference 3), and JP-A 2004-528686 (KOHYO) (Patent Reference 4).

The mercury-free lamps described in the above Patent References 1 to 4 are inventions completed in order to obtain properties same as or higher than those of a mercury-containing metal halide lamp at a color temperature of about 4000 K. Meanwhile, there are needs for a lamp having a high color temperature of exceeding 5000 K recently, and researches and developments on a mercury-free lamp having good properties at a high color temperature are in progress.

Patent Reference 1: JP-A 2004-288629 (KOKAI)
Patent Reference 2: JP-A 11-238488 (KOKAI)
Patent Reference 3: JP-A 2002-93368 (KOKAI)
Patent Reference 4: JP-A 2004-528686 (KOHYO)

DISCLOSURE OF THE INVENTION

For realization of a sodium-scandium-based mercury-free lamp having a high color temperature, an enclosed balance of scandium halide and sodium halide is most significant. But, if the enclosed balance is adjusted to provide 5000 K or more, a lamp voltage becomes excessively high, causing a problem such as flickering, and the lamp becomes dark. Thus, it is hard to realize a practical lamp.

The present invention has been made in view of the above circumstances and provides a practical metal halide lamp having a high color temperature and substantially not containing mercury.

According to an aspect of the present invention, there is provided a metal halide lamp, comprising an airtight tube having a discharge section in which a discharge space is formed; a discharge medium which is enclosed in the discharge space, contains metal halide exhibiting a molar ratio of sodium halide to scandium halide of 1.5 or below, halogen atoms bonded to metal in the metal halide mostly consisting of iodine and bromine atoms, a ratio of the bromine atoms being determined to be 10% to 50% in the total halogen atoms, a total enclosed amount per unit volume of the metal halide being 0.02 mg/μl or below in the discharge space, and contains 8 atm or higher of xenon but does not substantially contain mercury; and a pair of electrodes with their tip ends arranged to oppose to each other in the discharge space.

The present invention can provide a practical metal halide lamp having a high color temperature and substantially not containing mercury.

BRIEF DESCRIPTION OF THE DRAWINGS

FIG. 9 is a diagram illustrating the presence or not of electrode melting and crack leakage with the diameters of the electrode tip ends varied.

EXPLANATION OF REFERENCE NUMERALS

Explanation of Numerals

1 . . . Airtight tube, 11 . . . discharge section, 12*a*, 12*b* . . . sealing portion, 13*a*, 13*b* . . . non-sealing portion, 14 . . . discharge space, 2 . . . metal halide, 3*a*, 3*b* . . . mount, 3*a*1, 3*b*1 . . . metal foil, 3*a*2, 3*b*2 . . . electrode, 3*a*3, 3*b*3 . . . coil, 3*a*4, 3*b*4 . . . external lead wire, 3*c* . . . support wire, 4 . . . insulation tube, 5 . . . outer tube, 6 . . . socket, 71 . . . metal band, 72 . . . tongue piece, 8*a* . . . bottom terminal, 8*b* . . . side terminal.

BEST MODE FOR CARRYING OUT THE INVENTION (First Embodiment)

Figure 1:
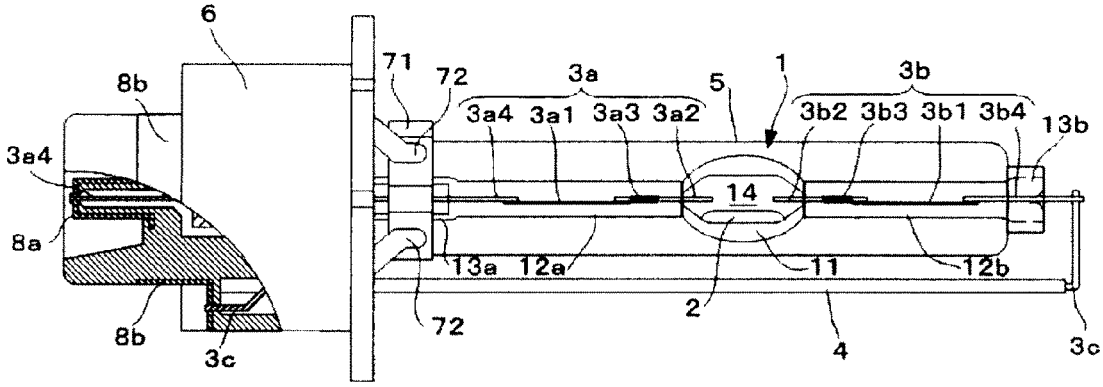
FIG. 1 is an overall view illustrating a first embodiment of the metal halide lamp of the present invention.

The metal halide lamp according to the embodiment of the present invention is described below with reference to the drawings. FIG. 1 is an overall view illustrating the first embodiment of the metal halide lamp of the present invention.

An airtight tube 1 configuring the discharge tube of the metal halide lamp has a long shape made of quartz glass, and a discharge section 11 having a substantially oval shape is formed substantially at its center. Plate-like sealing portions 12*a*, 12*b* are formed on individual ends of the discharge section 11, and cylindrical non-sealing portions 13*a*, 13*b* are formed at their ends. The airtight tube 1 is not limited to quartz glass but may also be configured of a material excelling in heat resistance and translucency such as ceramic.

A discharge space 14 having a substantially cylindrical center and both tapered ends in the axial direction is formed in the discharge section 11. The discharge space 14 desirably has a volume of 10 to 40 μl when its use is designated to vehicle headlights.

A discharge medium containing metal halide 2 and rare gas is enclosed in the discharge space 14.

The metal halide 2 includes scandium halide and sodium halide. A molar ratio of sodium halide to scandium halide is determined to be 1.5 or below in order to provide a color temperature of 5000 K or more. And, the molar ratio of sodium halide to scandium halide is preferably 0.5 or more. In this embodiment, metal halide for adjustment of chromaticity is also enclosed in addition to the above metal halide. The metal halide for adjustment of chromaticity is "metal halide which acts to decrease a y value on a CIE1931 xy chromaticity diagram" and includes, for example, indium halide and zinc halide. Tin halide, cerium halide and the like may be added depending on the purpose. A total enclosed amount of the metal halide 2 is 0.02 mg/μl or below. It is preferable that the total enclosed amount of the metal halide 2 is 0.005 mg/μl to 0.015 mg/μl.

Here, iodine and bromine atoms are used as halogen atoms to be bonded to metal in the metal halide 2 and occupy the majority of the halogen atoms. The "majority" means that 80% or more, desirably 90% or more, in the used halogen atoms, is iodine and bromine atoms. In other words, the halogen atoms such as chlorine atoms may be mixed partly, but it is optimum that the iodine and bromine atoms occupy 100%. In the total halogen atoms, a ratio of bromine atoms is determined to be 10% to 50%. It is preferable that a ratio of bromine atoms in the total halogen atoms is 20% to 40%. In this embodiment, sodium iodide, scandium iodide and indium bromide are used to configure. A combination of bonding metal and the iodine, or bromine atoms is not restricted. For example, scandium iodide and indium iodide may be used, and sodium bromide may be used. And, iodide and bromide with one metal in common may be used, such as sodium iodide, scandium iodide, and indium iodide and indium bromide.

As the rare gas, xenon is enclosed. Xenon has high luminous efficiency immediately after starting and acts mainly as starting gas. Since an emission color has a bluish color, a function to enhance the color temperature can also be obtained, and it is important to sufficiently enhance the total flux. This xenon enclosing pressure is 8 atm or more at room temperature (25° C.). The xenon enclosing pressure is preferably 9 atm or more at room temperature (25° C.) and desirably 20 atm or below at room temperature (25° C.). In a case where a ratio occupied by xenon is sufficiently high, namely 80 volume % or more, the enclosing pressure is allowed to be 8 atm or more by mixing with another rare gas such as argon. The enclosing pressure of the rare gas is preferably 15 atm or below.

The discharge space 14 does substantially not contain mercury. The "substantially not containing mercury" means that mercury is not contained at all or allows the presence of an amount approximately equal to a level that mercury is substantially not enclosed in comparison with a conventional mercury-containing discharge lamp, for example, a mercury amount of less than 2 mg per 1 ml, preferably 1 mg or less per 1 ml.

Mounts 3*a*, 3*b* are sealed in the sealing portions 12*a*, 12*b*. The mounts 3*a*, 3*b* are composed of metal foils 3*a*1, 3*b*1, electrodes 3*a*2, 3*b*2, coils 3*a*3, 3*b*3, external lead wires 3*a*4, 3*b*4.

The metal foils 3*a*1, 3*b*1 are formed of a thin metal plate made of, for example, molybdenum.

The electrodes 3*a*2, 3*b*2 are made of a material having a straight rod shape and composed mainly of tungsten, for example, a material having thorium oxide doped in tungsten. Their tip ends are arranged to oppose to each other in a state that a predetermined interelectrode distance is kept in the discharge space 14. The "predetermined interelectrode distance" is 5 mm or less, especially 3.7 mm to 4.7 mm, in view of an appearance distance for a short arc type lamp, and desirably about 4.2 mm when used for vehicle headlights.

Meanwhile, the base ends are connected to the ends of the metal foils 3*a*1, 3*b*1 on the side of the discharge section 11 by welding. In other words, electrode portions from the bonded portions with the metal foils 3*a*1, 3*b*1 to the discharge space 14 are sealed with the quartz glass of the sealing portions 12*a*, 12*b*.

The coils 3*a*3, 3*b*3 are made of, for example, doped tungsten and wound in a spiral shape around the electrodes 3*a*2, 3*b*2 from the ends of the metal foils 3*a*1, 3*b*1 toward the discharge space 14.

The external lead wires 3*a*4, 3*b*4 are made of, for example, molybdenum and connected to the ends of the metal foils 3*a*1, 3*b*1 opposite to the discharge section 11 by welding or the like. And, the other ends of the external lead wires 3*a*4, 3*b*4 are externally extended from the sealing portions 12*a*, 12*b* along the tube axis. One end of an L-shaped support wire 3*c* made of nickel is connected to the lead wire 3*b*4 on the front end extended to the outside, and the other end is extended toward a socket 6 described later. And, a part of the support wire 3*c* parallel with the tube axis is covered with an insulation sleeve 4 made of ceramic.

An oxide of titanium, cerium, aluminum or the like is added to quartz glass to provide the exterior of the airtight tube 1 configured as described above with a cylindrical outer tube 5, which has a function to block ultraviolet, substantially concentrically with the airtight tube 1 along the tube axis. They are connected by melting the cylindrical non-sealing portions 13*a*, 13*b* at both ends of the airtight tube 1 and both ends of the outer tube 5. For example, a single gas or a mixture of two or more of rare gases such as nitrogen, neon, argon, xenon and the like can be enclosed into the space formed by the airtight tube 1 and the outer tube 5.

A socket 6 is connected to the outer tube 5, which covers the airtight tube 1 therein, on the side of the non-sealing portion 13*a*. They are connected by holding a metal band 71, which is mounted on the outer circumferential surface of the outer tube 5 near the non-sealing portion 13*a*, by four metal tongue pieces 72 (two shown in FIG. 1) formed at the open end of the socket 6 on the side of holding the airtight tube 1. And, to further enhance the connection, the contact points between the metal band 71 and the tongue pieces 72 are welded. A bottom terminal 8*a* is formed on the bottom of the socket 6 and connected to the lead wire 3*a*4. And, a bottom terminal 8*b* is formed on the side wall of the socket 6 and connected to the support wire 3*c*.

The metal halide lamp configured as described above is arranged with its tube axis in a substantially horizontal state, and a lighting circuit (not shown) is electrically connected to the bottom terminal 8*a* and the side terminal 8*b*. At the time of starting, power two times greater than the stable time power, for example, power of about 75 W at the starting time or about 35 W at the stable time, is supplied to turn on the light.

Figure 2:
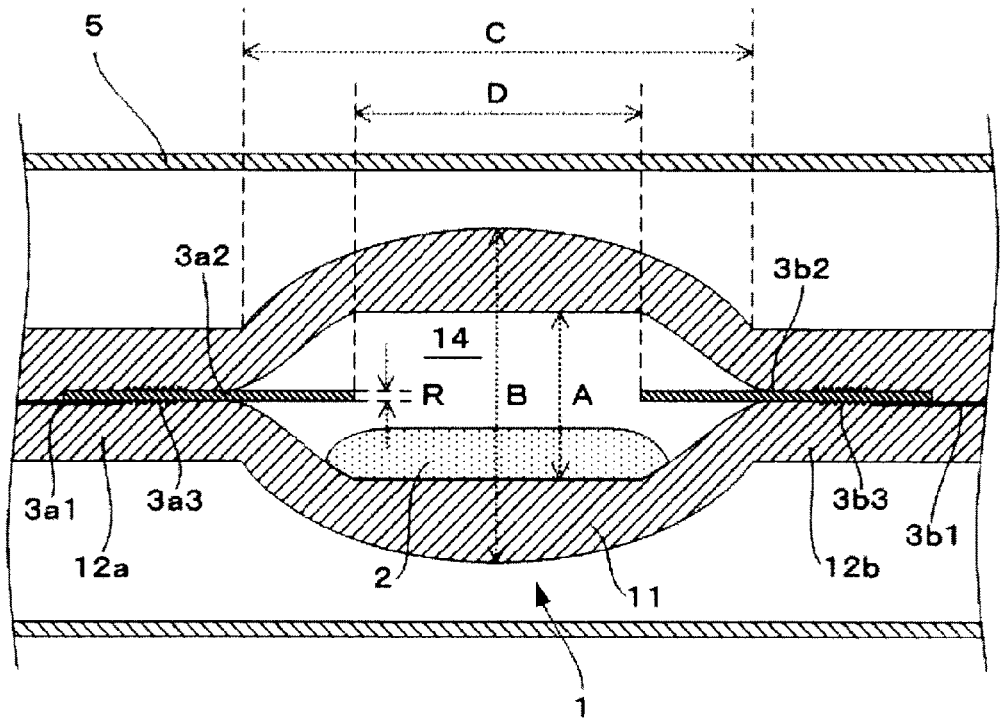
FIG. 2 is a diagram illustrating one example of the metal halide lamp of the present invention.

Referring to FIG. 2, an example of the metal halide lamp of the present invention is described. A ratio of Br atoms to a total enclosed halogen atoms is calculated from the number of Br atoms/total number of halogen atoms. The following various tests are performed using dimensions and materials according to the described specifications unless otherwise described.

Discharge tube 1: Made of quartz glass; volume of discharge space 14=25 μl; Inner diameter A=2.5 mm; Outer diameter B=6.2 mm; Longitudinal spherical body length C=7.8 mm Metal halide 2: $ScI_3$=0.20 mg; NaI=0.08 mg; $ZnI_2$=0.01 mg; InBr=0.14 mg; Total enclosed amount=0.017 mg/μl; (a molar ratio of NaI to $ScI_3$=1.14, ratio of Br to total enclosed halogen atoms=26.4%)

Rare gas: Xenon=10.0 atm

Mercury: 0 mg

Metal foils 3*a*1, 3*b*1: Made of molybdenum

Electrodes 3*a*2, 3*b*2: Made of thoriated tungsten; Diameter R=0.33 mm; Interelectrode distance D=4.4 mm (distance in appearance)

Coils 3a3, 3b3: Made of doped tungsten, Coil diameter=0.06 mm; Coil pitch=250%

External lead wires 3a4, 3b4: Made of molybdenum; Diameter=0.6 mm

Lighting conditions: 75 W (2.8 A) just after lighting; 35 W (0.7 A) at a stable time The above example realizes lamp characteristics such as a color temperature of 5500 K, a lamp voltage of 52V, and a total flux of 2350 lm.

Figures 3, 4:
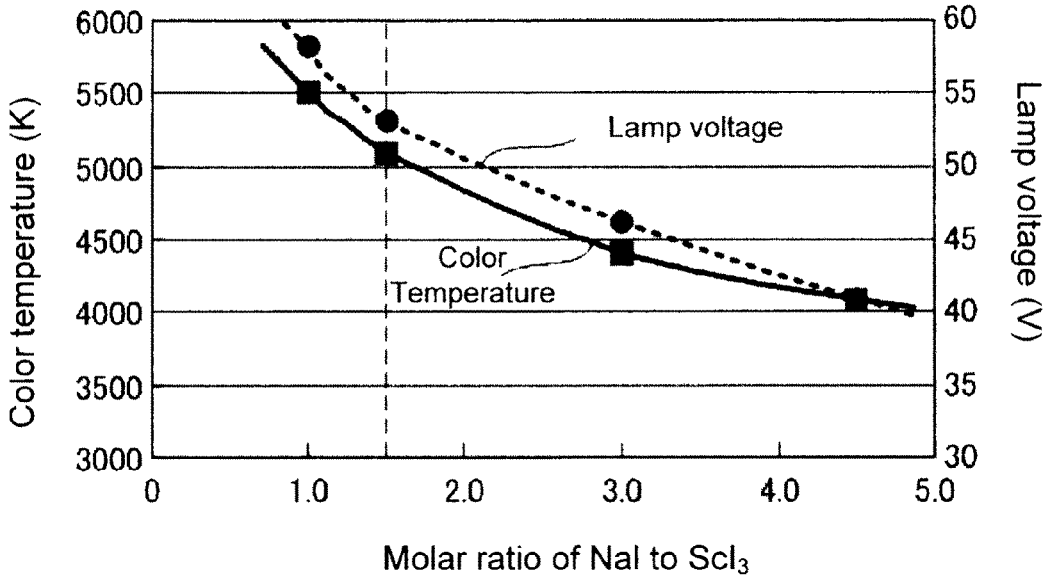
FIG. 3 is a diagram illustrating changes in color temperature and lamp voltage with a molar ratio of NaI to $ScI_3$ varied.
FIG. 4 is a diagram illustrating changes in lamp characteristics with a ratio between iodine and bromine atoms varied.

FIG. 3 is a diagram illustrating changes in color temperature and lamp voltage with a molar ratio of NaI to $ScI_3$ varied.

It is apparent from the results that the color temperature increases as the molar ratio of NaI to $ScI_3$ decreases, and the color temperature of 5000 K can be achieved when the molar ratio is 1.5. In other words, the color temperature of 5000 K can be obtained by adjusting the molar ratio of NaI to $ScI_3$ to 1.5 or below. Meanwhile, the lamp voltage also increases as the molar ratio of NaI to $ScI_3$ decreases, and the lamp voltage becomes 50V or more when the molar ratio becomes 1.5 or below. Incidentally, the results shown in FIG. 3 are substantially same eve if types of halogen atoms bonded to scandium or sodium are different.

The mercury-free lamp is known as a lamp which tends to cause flickering. Especially, when the lamp voltage is excessively high, flickering tends to occur because the electrodes at the stable time have a low current density. Therefore, it is necessary to keep the lamp voltage in a suitable range. As means for lowering the lamp voltage, there is a method of lowering the xenon pressure. But, when the xenon pressure is lowered, the total flux is lowered considerably, and practical brightness cannot be obtained when the lamp is used for vehicle headlights and the like. Therefore, it is not appropriate to decrease the xenon pressure, but it is necessary to enclose at 8 atm or more. The upper limit of the xenon pressure is not particularly determined but desirably 20 atm or below.

As another means of decreasing the lamp voltage, the inventor has focused on the halogen atoms. FIG. 4 is a diagram illustrating changes in lamp characteristics with the ratio of iodine and bromine atoms varied in the above example.

It is apparent from the results that the lamp voltage decreases as the bromine atoms increase. In other words, the lamp voltage can be adjusted to an appropriate value by adjusting the ratio of the bromine atoms. But, it has become apparent that when the bromine atoms are increased, the temperature of the lower part of the discharge section 11 where the metal halide 2 is deposited decreases. In other words, the metal halide 2 is hardly vaporized, exerting an influence upon a decrease in total flux, a delay in light flux rising, and the like. Under such circumstances, it is not suitable if the ratio of the bromine atoms is excessively high, and it is desirably 50% or below.

Meanwhile, it was confirmed that if the ratio of the bromine atoms was low, flickering was caused easily. Its cause is considered a decrease in current density at the stable state. And, it was found that when iodine atoms are many, the electrodes are liable to melt heavily. Therefore, it is desirable that the ratio of bromine atoms is 10% or more.

Figure 5:
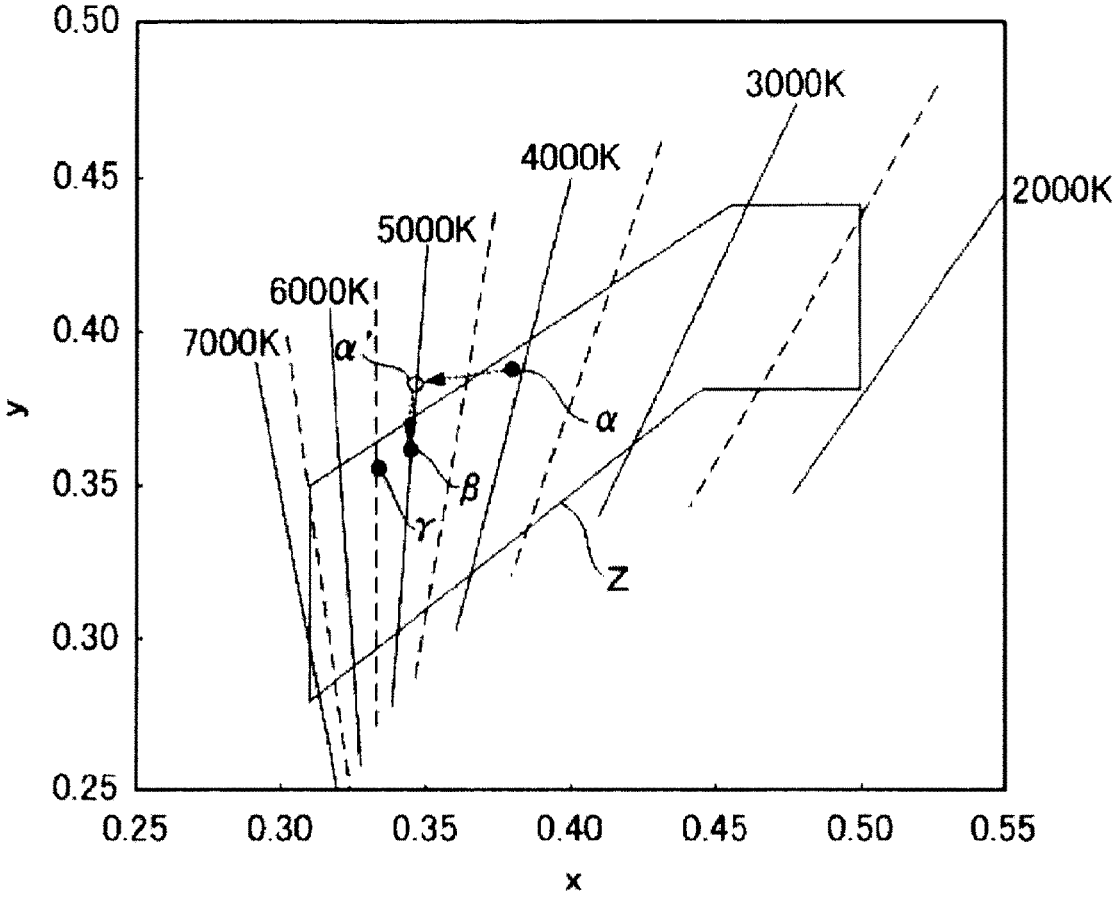
FIG. 5 is a diagram illustrating a change in chromaticity on a CIE1931 xy chromaticity diagram.

As described above, the color temperature increases as the molar ratio of sodium halide to scandium halide is decreased, but a change in chromaticity involved in the color temperature change becomes a change that substantially chromaticity x only becomes small on the CIE1931 xy chromaticity diagram. Specifically, when a lamp (color temperature 4100 K, chromaticity x=0.380, chromaticity y=0.387, total flux 3100 lm) having chromaticity at point α shown in FIG. 5 is changed to have the color temperature of 5000 K by varying only a molar ratio without varying the total amount of scandium halide and sodium halide, the chromaticity changes to point α' on the chromaticity diagram. The lamp having chromaticity at α' is not a desirable lamp because the chromaticity is outside of white range Z specified by JIS (Japanese Industrial Standards).

To put the lamp with chromaticity at the point α' into the above white range Z, it is necessary to enclose the metal halide for adjustment of chromaticity to decrease a y value. As the metal halide for adjustment of chromaticity, indium halide and zinc halide are suitable, and when they are enclosed in an appropriate amount, the chromaticity can be moved to point β (color temperature 5000 K, chromaticity x=0.345, chromaticity y=0.360, total flux 2650 lm). But, since indium halide and zinc halide also have functions to decrease the total flux and to increase the lamp voltage, a molar ratio of indium halide and/or zinc halide to scandium halide and sodium halide is desirably 2.0 or below. And, a molar ratio of indium halide and/or zinc halide to scandium halide and sodium halide is desirably 0.3 or more. Similarly, when a lamp having a color temperature of 5500 K is produced, a molar ratio of scandium halide and sodium halide is changed, and a y value is decreased by metal halide for adjustment of chromaticity. Thus, a lamp having chromaticity at a point γ (color temperature 5500 K, chromaticity x=0.332, chromaticity y=0.355, total flux 2550 lm) can be realized. The total enclosed amount of metal halide 2 per unit inner volume in a discharge space is finally required to be 0.02 mg/μl (total enclosed amount of metal halide 2/volume of discharge space 14) or below, and preferably 0.005 mg/μl to 0.015 mg/μl in view of the lamp voltage.

Therefore, in a mercury-free metal halide lamp containing 8 atm or more of xenon and metal halide 2 having a molar ratio of sodium halide to scandium halide of 1.5 or below according to this embodiment, a ratio of bromine atoms in the metal halide 2 in which the majority of halogen atoms bonded to metal in the metal halide is determined to be 10% to 50% and a total enclosed amount of the metal halide 2 is determined to be 0.02 mg/μl or below. Thus, a practical bright metal halide lamp which has a color temperature of 5000 K or more and hardly causes flickering can be realized. By configuring to additionally contain indium halide and/or zinc halide, a metal halide lamp that a y value can be decreased on the CIE1931 xy chromaticity diagram and chromaticity xy satisfies the white color range specified by JIS can be realized.

The metal halide lamp according to another example of the present invention is described below. In the description of the metal halide lamp according to this example, descriptions overlapping with those of the previous example will be omitted.

In this example, the metal halide lamp which can suppress the occurrence of leakage (hereinafter referred to as "crack leakage") due to a crack produced in the sealing portion will be described. In other words, since it was confirmed that there is a lamp suffering from crack leakage when the enclosed balance of sodium and scandium is adjusted to have a color temperature of 5000 K or more, a lamp which suppresses the occurrence of crack leakage is described. The metal halide 2 of this embodiment is comprised of scandium halide, sodium halide, indium halide and zinc halide. The molar ratio of sodium halide to scandium halide must be 1.5 or below to provide a color temperature of 5000 K or more. And, zinc halide is enclosed to suppress the electrodes from melting, and its enclosed amount is desirably very small. The enclosed amount of zinc halide according to the present invention is suitably 1.0 wt % to 5.0 wt %. And, the enclosed amount of zinc halide is more preferably 2.0 wt % to 4.0 wt %.

Here, as the halogen to be bonded to metal in the metal halide 2, it is most suitable to select iodine whose reactivity is low in halogen. But, when all metals in the metal halide are bonded to iodine and enclosed into the discharge space 14, the electrodes tend to melt when lighting, so that it is desirable to combine halogen other than iodine such as bromine with iodine.

As the rare gas, xenon which has high luminous efficiency just after starting and acts mainly as starting gas is enclosed. The pressure of the rare gas is desirably 8 to 18 atm at normal temperature (25° C.) because it has a large effect on light flux rising. Neon, argon, krypton or the like or a combination of them may also be used other than the xenon.

In this embodiment, the electrodes 3*a*2, 3*b*2 are made of a material having a straight rod shape and composed mainly of tungsten, for example, a material having thorium oxide doped in tungsten. Their tip ends are arranged to oppose to each other in a state that a predetermined interelectrode distance is kept in the discharge space 14. The "predetermined interelectrode distance" is 5 mm or less in view of an appearance interelectrode distance for a short arc type lamp, especially 3.7 mm to 4.7 mm, and desirably about 4.5 mm when used for vehicle headlights. And, the tip ends of the electrodes 3*a*2, 3*b*2 desirably have a diameter R of 0.25 mm to 0.38 mm. The tip ends of the electrodes 3*a*2, 3*b*2 more desirably have a diameter R of 0.30 mm to 0.35 mm.

Another example of the metal halide lamp according to the embodiment is described below. The following various tests are performed using dimensions and materials according to the described specifications unless otherwise described.

Discharge tube 1: Made of quartz glass; Volume of discharge space 14=25 μl; Inner diameter A=2.5 mm; Outer diameter B=6.2 mm; Longitudinal spherical body length C=7.8 mm Metal halide 2: $SCI_3$=0.20 mg; NaI=0.08 mg; InBr=0.14 mg; $ZnI_2$=0.01 mg; (a molar ratio of sodium halide to scandium halide=1.14)

Rare gas: Xenon=10.0 atm

Mercury: 0 mg

Metal foils 3*a*1, 3*b*1: Made of molybdenum

Electrodes 3*a*2, 3*b*2: Made of thoriated tungsten; Diameter R=0.33 mm; Interelectrode distance D=4.2 mm Coils 3*a*3, 3*b*3: Made of doped tungsten; Coil diameter=0.06 mm; Coil pitch=250%

External lead wires 3*a*4, 3*b*4: Made of molybdenum; Diameter=0.6 mm Lighting conditions: 75 W (2.8 A) just after lighting; 35 W (0.7 A) at a stable time The above example has realized lamp characteristics such as a color temperature of 5400 K, a lamp voltage of 51V and a total flux of 2250 lm.

Figures 6, 7:
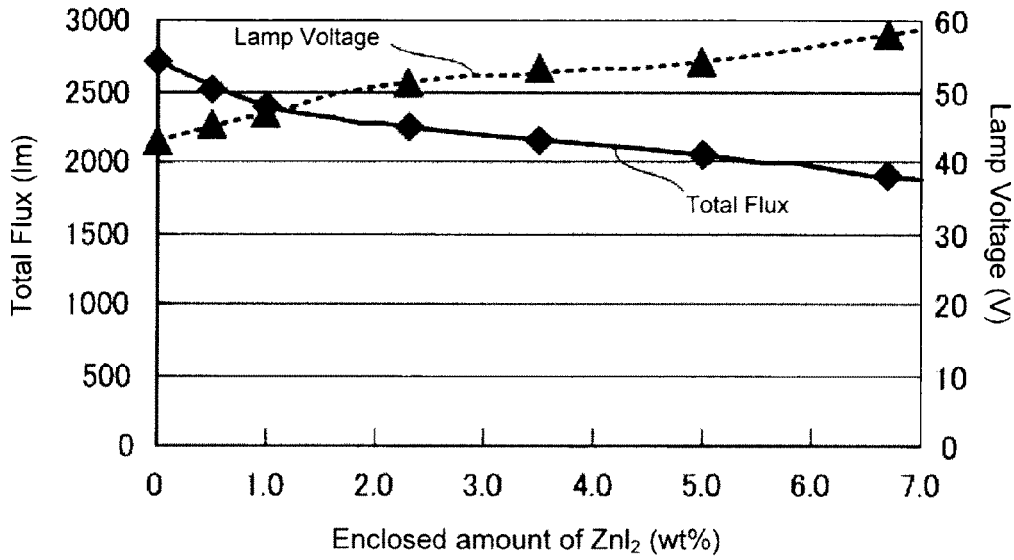
FIG. 6 is a diagram illustrating changes in various lamp characteristics with an enclosed amount of $ZnI_2$ varied.
FIG. 7 is a graph of changes in total flux and lamp voltage to the enclosed amount of $ZnI_2$ of FIG. 4.

A test of varying the enclosed amount of zinc iodide was performed. The test was performed with the amount of zinc iodide ($ZnI_2$) increased while keeping the amounts of other metal halides at predetermined levels under the above-described conditions of the embodiment. The results are shown in FIG. 6. Presence or not of crack leakage in the drawing was obtained by performing a blinking cycle of the rated-life test mode (EU mode) specified in JEL (Japan Electric Lamp Manufacturers Association Regulation) which is a standard of a vehicle headlight=HID light source and checking whether a crack which causes leakage was caused in the sealing portion within 1000 hours.

It is seen from FIG. 6 that when the enclosed amount of zinc iodide is less than 1.0 wt %, crack leakage occurs but when it is 1.0 wt % or more, crack leakage does not occur. Meanwhile, it is also apparent from FIG. 7 showing the results of FIG. 6 that the total flux decreases and the lamp voltage increases as the enclosed amount of zinc iodide increases. And, when the enclosed amount of zinc iodide is larger than 5.0 wt %, the lamp voltage increases excessively, resulting in occurrence of flickering. Therefore, the enclosed amount of zinc iodide is desirably 1.0 wt % to 5.0 wt %. It is also desirable that the enclosed amount of zinc iodide is 2.0 wt % to 4.0 wt %. The results of FIG. 6 and FIG. 7 are substantially same even if kinds of halogens to be bonded to metal in the metal halide are different.

The cause of generating the above-described crack leakage and the effect of enclosing zinc halide are considered as follows.

Figure 8A:
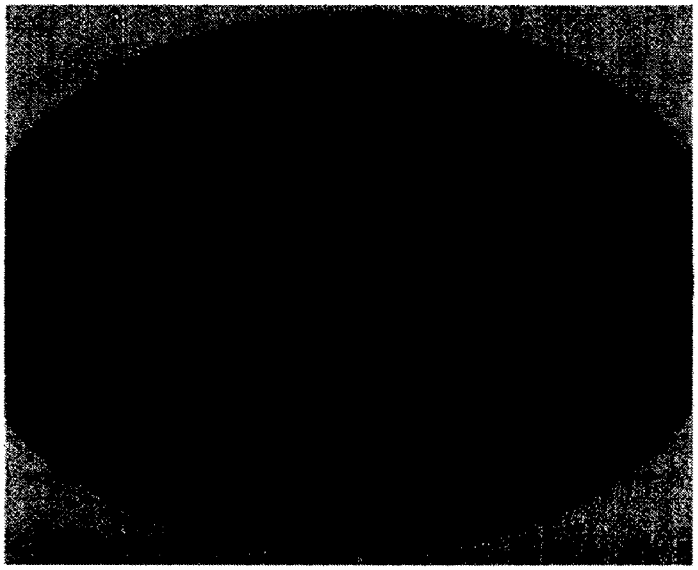
FIG. 8A is a diagram showing an X-ray photograph of the electrodes and their periphery of a lamp 1 ($ZnI_2$=0 wt %) after lighting in EU mode for 43 hours.
Figure 8B:
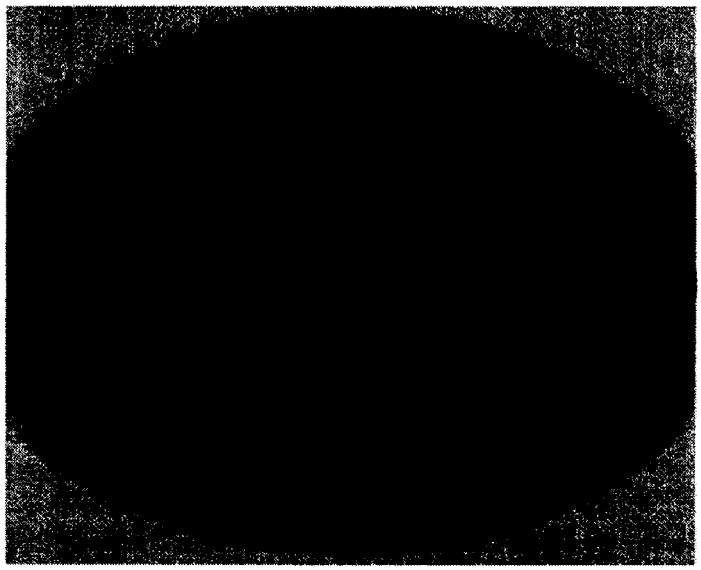
FIG. 8B is a diagram showing an X-ray photograph of the electrodes and their periphery of a lamp 4 ($ZnI_2$=1.0 wt %) after lighting in EU mode for 43 hours.

FIGS. 8A and 8B are diagrams showing X-ray photographs of the electrodes and peripheries after lighting in an EU mode for 43 hours. FIG. 8A shows a lamp 1 ($ZnI_2$=0 wt %), and FIG. 8B shows a lamp 4 ($ZnI_2$=1.0 wt %). It is apparent from FIGS. 8A and 8B that the electrode tip ends of the lamp 1 are heavily melted, while melting of the electrode tip ends of the lamp 4 is not observed, and substantially the initial lighting state is maintained. Therefore, it is considered that the crack leakage is related to the melting of the electrode tip ends. The inventor considers from the results of the study that when the electrode tip ends are melted like the lamp 1, first, it becomes hard to form an arc spot, electron-releasing ability decreases and the electrode axis temperature increases and second, the position where the arc spot is formed becomes closer to the sealing portion to increase the sealing portion temperature, resulting in the occurrence of the crack leakage. Meanwhile, the electrodes of the lamp 4 in which a very small amount of zinc iodide was enclosed were hardly melted. It is considered that the arc spot was stably formed at the electrode tip ends.

As apparent from Patent Reference 2 and the like, zinc halide has been conventionally enclosed into the mercury-free lamp as a lamp-voltage-forming medium instead of mercury. Meanwhile, the mercury-free lamp whose molar ratio of sodium halide to scandium halide is 1.5 or below as in the present invention has a lamp voltage of around 45 to 50V suitable for the mercury-free lamp and does not require zinc halide in terms of design. Since zinc halide had side effects of lowering total flux to darken the lamp as shown in FIG. 7, it was considered that a mercury-free lamp having a high color temperature did not need to enclose zinc halide. As described above, however, it is found that zinc halide has an effect to suppress melting of the electrode tip ends. Then, even if characteristics such as lamp voltage and total flux decrease, it becomes necessary to enclose a very small amount of zinc halide, and the present invention has been achieved.

To suppress melting of the electrode tip ends and crack leakage due to melting, it is desirable that a diameter R of the electrode tip end and halogen bonded to metal halide are suitably combined.

FIG. 9 is a diagram illustrating the presence or not of electrode melting and crack leakage with the diameters R of the electrode tip ends varied.

It is seen from the results that it is not desirable regardless of whether the diameter R of the electrode tip end is small or large. It was conventionally known that if the diameter R of the electrode tip end is small, it is not desirable because the tip end has an excessively high temperature. Therefore, it was considered that the electrode tip end has a lower temperature and becomes hard to be melted as the diameter R of the tip end becomes larger. But it is confirmed that the electrode tip end is easily melted even if the diameter R of the electrode tip end is large. It is thought that the delay of time when the arc spot is stably formed at the electrode tip end is the cause of melting. Therefore, the diameter R of the electrode tip end is suitably 0.25 mm to 0.38 mm. And, the diameter R of the electrode tip end is more suitably 0.30 mm to 0.35 mm.

Halogen to be bonded to metal in the metal halide is suitably configured of iodine having low reactivity, and it is desirable not to configure by iodine alone but a combination with another halogen such as bromine is desirable. It is because when the metal halide is configured of iodine alone, it is not known exactly why but lamps often had melted electrodes. Meanwhile, it is confirmed that the electrode is suppressed from melting by bonding to metal in the metal halide some halogen other than iodine, for example 10% to 50%, preferably 20% to 40%, of bromine to iodine.

Therefore, in this embodiment, a molar ratio of sodium halide to scandium halide is 1.5 or below, and 1.0 wt % to 5.0 wt % of zinc halide is contained. Thus, a mercury-free lamp having a color temperature of 5000 K or more can be realized, and crack leakage due to electrode melting which tends to occur when configured as above can be suppressed. And, a diameter R of the tip ends of the electrodes 3*a*2, 3*b*2 is determined to be 0.25 mm to 0.38 mm, and halogen bonded to the metal halide 2 is comprised of iodine and another halogen, thereby providing a configuration further effective for electrode melting, and the crack leakage can be suppressed.

Industrial Applicability

The present invention can provide a practical metal halide lamp which has a high color temperature and does not substantially contain mercury by suppressing flickering or the like of the lamp, and can be applied to, for example, a discharge lamp device for vehicle headlights.

What is claimed is:

1. A metal halide lamp, comprising: an airtight tube having a discharge section with a discharge space formed therein; a discharge medium enclosed in the discharge space, the discharge medium containing metal halide exhibiting a molar ratio of sodium halide to scandium halide of 1.5 or below, the metal halide having halogen atoms bonded to metal therein mostly consisting of iodine and bromine atoms, the metal halide having a bromine at a rate of 10% to 50% by a ratio of the bromine atoms to the total halogen atoms, the metal halide being enclosed with a total enclosed amount per unit volume of the metal halide being 0.02 mg/μl or below in the discharge space, and 8 atm or higher of xenon, wherein the discharge medium does not substantially contain mercury; and a pair of electrodes with their tip ends arranged to oppose to each other in the discharge space, and wherein the metal halide further contains 1.0 wt % to 5.0 wt % zinc halide.

2. The metal halide lamp according to claim 1, wherein the metal halide further contains metal halide for adjustment of chromaticity to decrease a y value on a CIE1931 xy chromaticity diagram.

3. The metal halide lamp according to claim 2, wherein the metal halide for adjustment of chromaticity is indium halide and/or zinc halide.

4. The metal halide lamp according to claim 1, wherein the electrode tip ends have a diameter R of 0.25 mm to 0.38 mm.

5. The metal halide lamp according to claim 1, wherein halogen bonded to metal in the halide has 20% to 40% of the bromine atoms.

6. The metal halide lamp according to claim 1, wherein the metal halide further contains 2.0 wt % to 4.0 wt % of zinc halide.

* * * * *